US010990056B2

(12) United States Patent
Umeno

(10) Patent No.: US 10,990,056 B2
(45) Date of Patent: Apr. 27, 2021

(54) IMAGE FORMING APPARATUS

(71) Applicant: KONICA MINOLTA, INC., Tokyo (JP)

(72) Inventor: Hideyuki Umeno, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/934,184

(22) Filed: Jul. 21, 2020

(65) Prior Publication Data

US 2021/0063939 A1 Mar. 4, 2021

(30) Foreign Application Priority Data

Sep. 4, 2019 (JP) ..... JP2019-160870

(51) Int. Cl.
*G03G 15/00* (2006.01)
*G03G 21/16* (2006.01)

(52) U.S. Cl.
CPC ..... *G03G 15/751* (2013.01); *G03G 15/5008* (2013.01); *G03G 15/757* (2013.01); *G03G 21/1661* (2013.01); *G03G 2221/16* (2013.01)

(58) Field of Classification Search
CPC ..... G03G 15/751; G03G 21/1661; G03G 15/5008; G03G 15/757; G03G 2221/16
See application file for complete search history.

(56) References Cited

U.S. PATENT DOCUMENTS 4,708,455 A * 11/1987 Kubota ..... G03G 21/185 399/111

FOREIGN PATENT DOCUMENTS

JP H09166898 A 6/1997
JP 2004220047 A 8/2004

* cited by examiner

*Primary Examiner* — Susan S Lee
(74) *Attorney, Agent, or Firm* — Holtz, Holtz & Volek PC

(57) ABSTRACT

An image forming apparatus includes a processing unit, a main frame, a drive source, and a door-type positioning panel. The processing unit performs at least part of image formation. The main frame supports the processing unit such that the processing unit is pulled out or housed. The drive source is provided on the main frame and connected to a first end of a processing drive shaft of the processing unit to provide rotative power. The door-type positioning panel positions and supports a second end of the processing drive shaft by using an insert hole. An end of the door-type positioning panel is supported by the main frame such that the panel swings on a support axis. The door-type positioning panel includes a fit hole that is closer to a swinging end of the panel than to the support axis and fits to a positioning shaft provided on the main frame.

19 Claims, 12 Drawing Sheets

IMAGE FORMING APPARATUS

CROSS-REFERENCE TO RELATED APPLICATIONS

The entire disclosure of Japanese Patent Application No 2019-160870 filed on Sep. 4, 2019 is incorporated herein by reference in its entirety.

BACKGROUND

Technological Field

The present disclosure relates to an image forming apparatus.

Description of Related Art

Photoconductive drums of image forming apparatuses need to be replaced. A known image forming apparatus supports a drum(s) in a casing that can be slidingly pulled out of the main body of the apparatus so that the drum is removable (for example, disclosed in JPH09-166898A and JP2004-220047A).

In such a structure, the driving shaft of the drum is left in the main body of the apparatus. When the drum and the casing are both pulled out, the driving shaft is relatively pulled out from the drum. When the drum and the casing are both pushed back to the main body of the apparatus, the driving shaft is again inserted in the drum.

SUMMARY

The positions of drive shafts of photoconductive drums affect quality of formed images and hence need to be determined accurately.

In the known image forming apparatus, one end of the drive shaft of the photoconductive drum is connected to a drive source mounted to the main body of the apparatus, thereby being kept with high positional accuracy.

However, another end of the drive shaft of the photoconductive drum is supported by a slidable casing that can be pulled out of the main body of the apparatus and may not be kept with high positional accuracy.

The main body of the apparatus has two positioning projections, and the casing that can be pulled out has two positioning holes on the upper part. When the casing is pushed back to the main body, the positioning projections are inserted in the positioning holes. The two positioning holes on the upper part and a rail(s) on which the casing slides determine the position of the casing. However, the rail on which the casing slides needs to have play in the up and down directions to allow the casing to slide smoothly when the weight of the pulled-out casing loads on the rail. Thus, the position of the casing is substantially determined by the positioning holes on the upper part. Because the lower end of the casing may shake, the photoconductive drum may not be kept at a sufficiently accurate position.

Objects of the present disclosure include keeping the positions of components with high positional accuracy.

To achieve at least one of the abovementioned objects, according to an aspect of the present invention, there is provided an image forming apparatus, including:

a processing unit that performs at least part of image formation;

a main frame that supports the processing unit such that the processing unit is pulled out or housed;

a drive source that is provided on the main frame and connected to a first end of a processing drive shaft of the processing unit to provide rotative power to the processing drive shaft; and a door-type positioning panel that positions and supports a second end of the processing drive shaft by using an insert hole, wherein an end of the door-type positioning panel is supported by the main frame such that the door-type positioning panel swings on a support axis, and the door-type positioning panel includes a fit hole that is closer to a swinging end of the door-type positioning panel than to the support axis and fits to a positioning shaft provided on the main frame.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF THE EMBODIMENTS

Hereinafter, one or more embodiments of the present invention will be described with reference to the drawings. However, the scope of the invention is not limited to the disclosed embodiments.

[Image Forming Apparatus]

Figure 1:
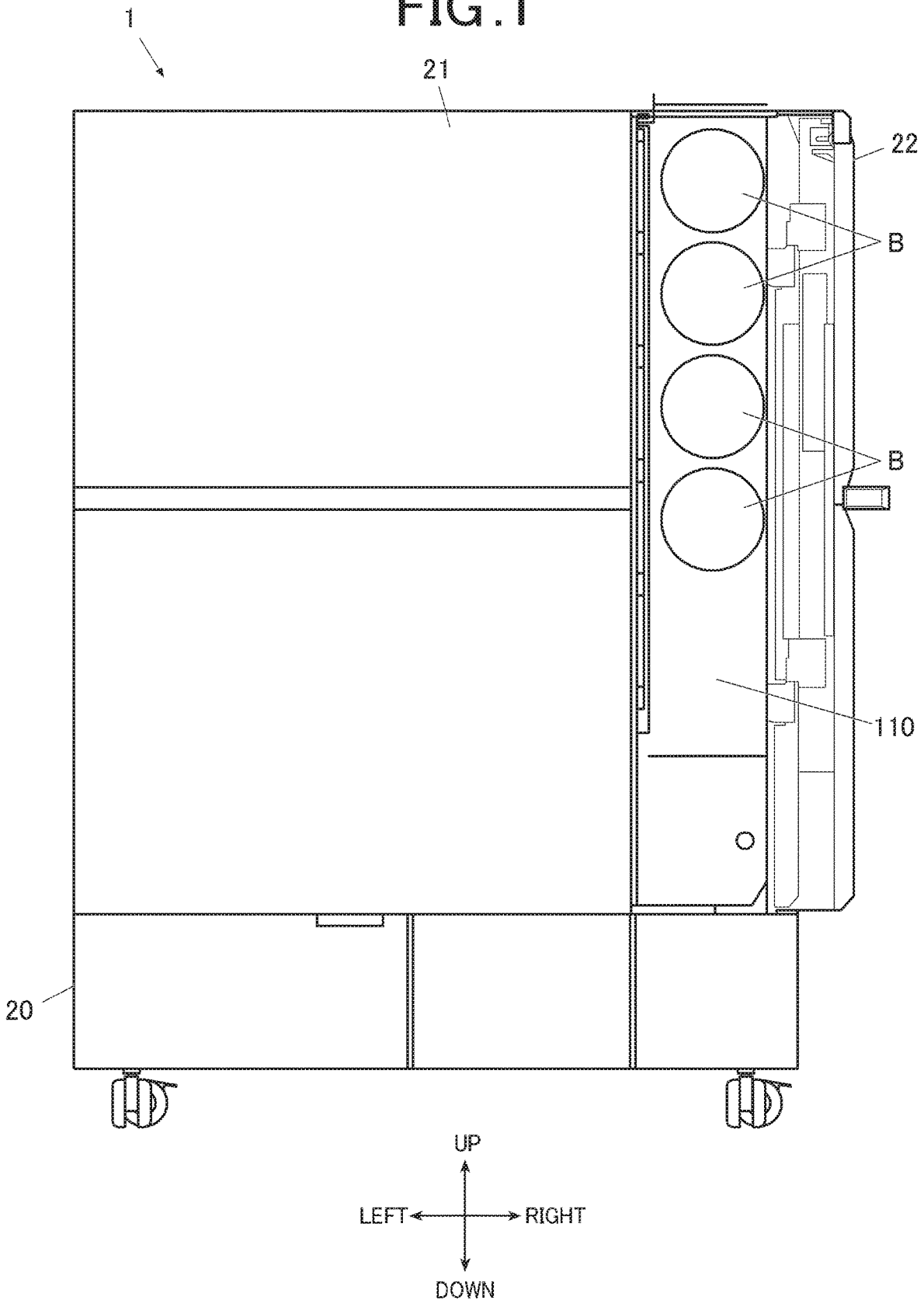
FIG. 1 is a front view of an image forming apparatus with a compartment door opened according to an embodiment.
Figure 2:
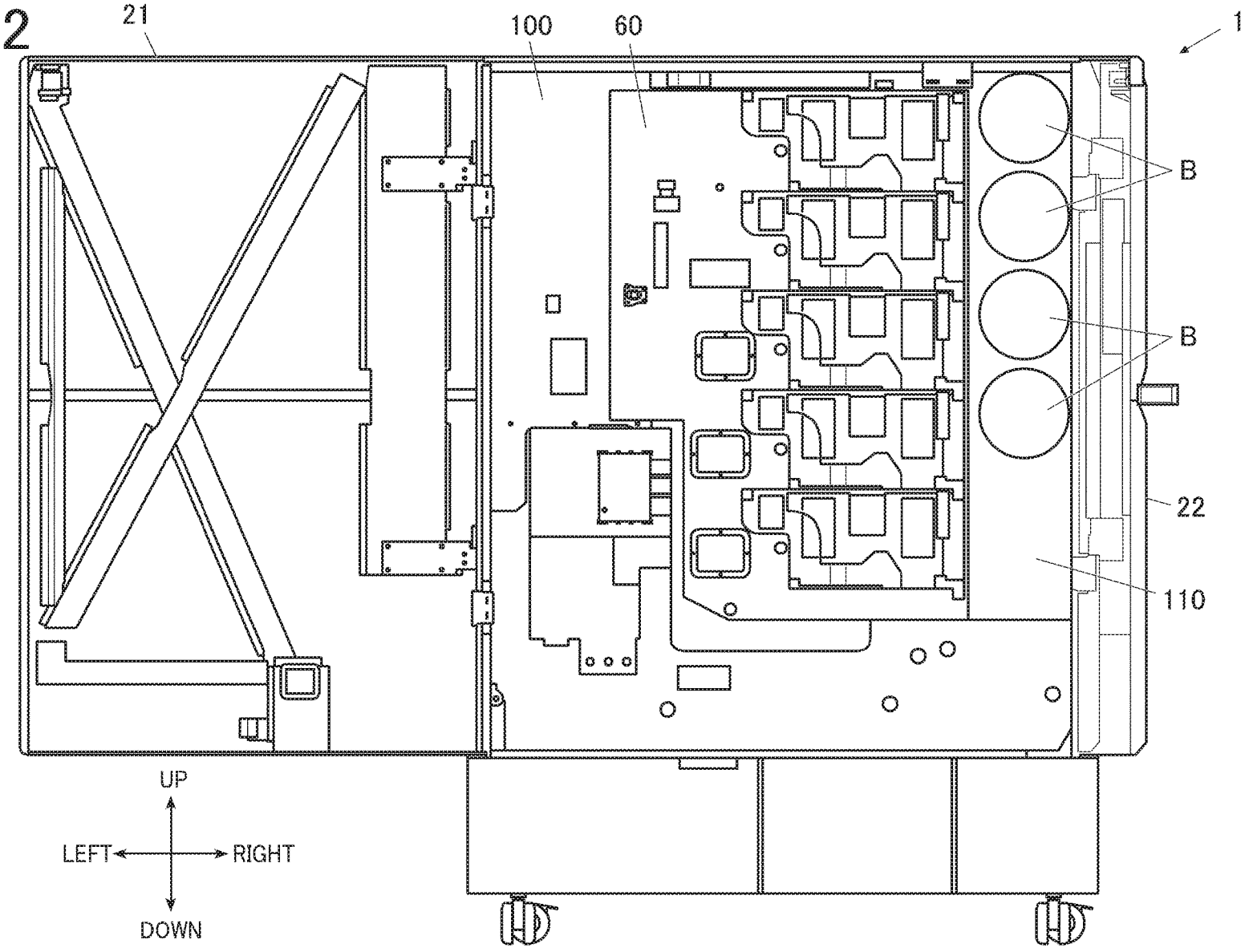
FIG. 2 is a front view of the image forming apparatus with the compartment door and an outer door opened.
Figure 3:
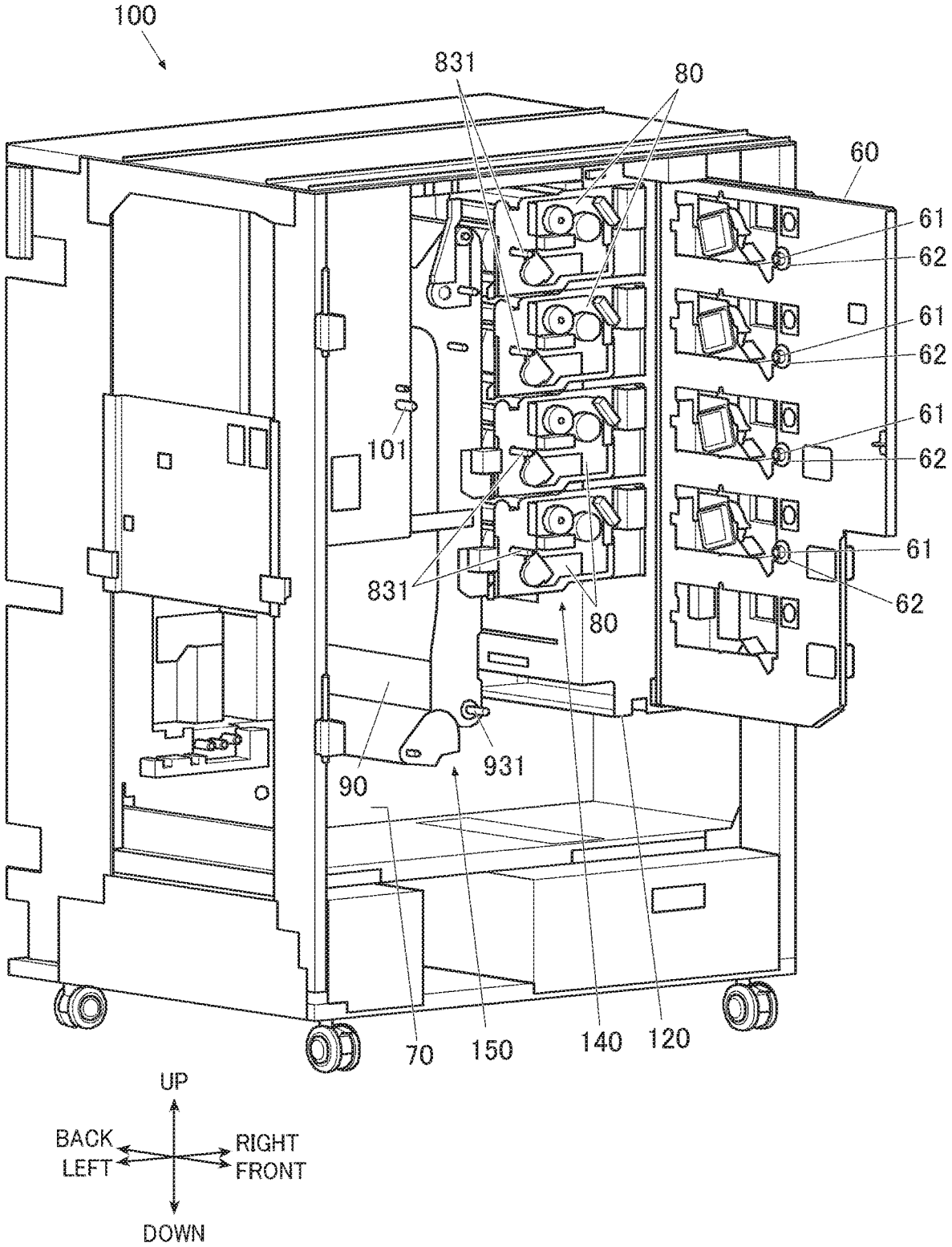
FIG. 3 is a perspective view of a main frame with a door-type positioning panel opened.
Figure 4:
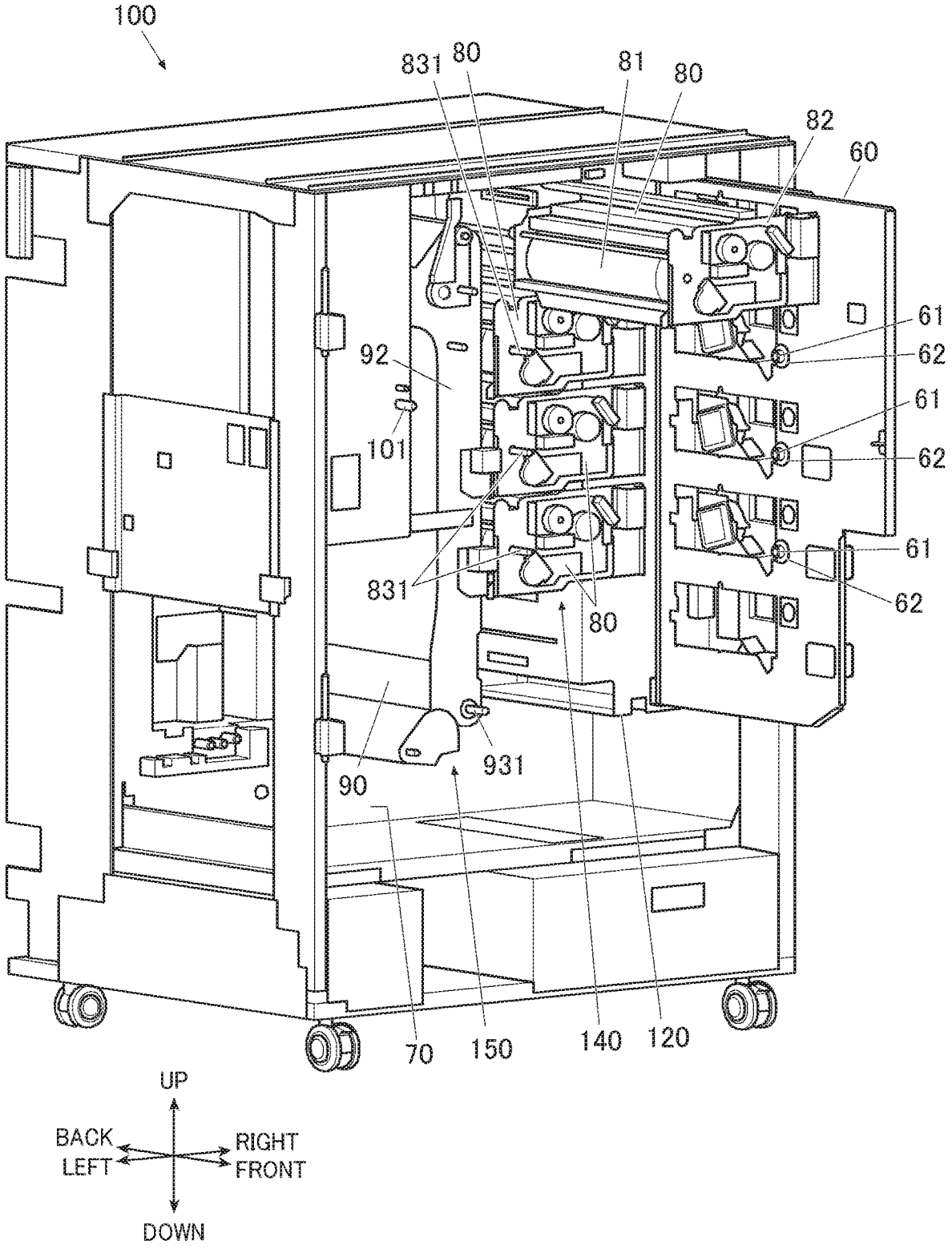
FIG. 4 is a perspective view of the main frame with one of drum units pulled out.
Figure 5:
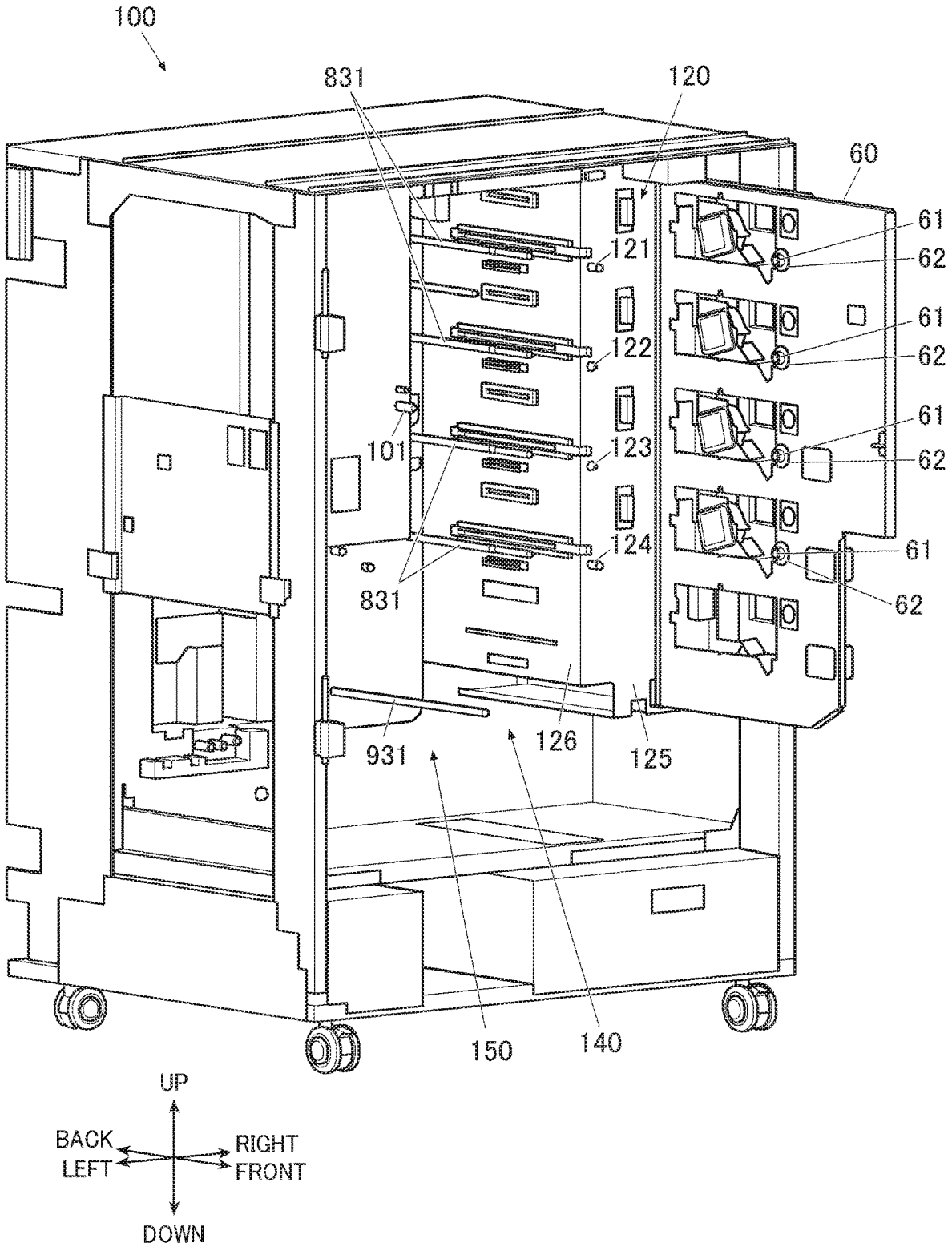
FIG. 5 is a perspective view of the main frame with all the drum units pulled out.

FIG. 1 is a front view of an image forming apparatus 1 with a compartment door 22 opened. FIG. 2 is a front view of the image forming apparatus 1 with the compartment door 22 and an outer door 21 opened. FIGS. 3 to 5 are perspective views of the main body 100 of the image forming apparatus 1. FIG. 3 shows a state in which a door-type positioning panel 60 is opened. FIG. 4 shows a state in which one of drum units 80 is pulled out. FIG. 5 shows a state in which all the drum units 80 are taken out.

As shown in FIGS. 1 to 5, the image forming apparatus 1 includes an outer cover 20, the outer door 21, the compartment door 22, a main frame 100, the drum units 80 as processing units, and an intermediate transfer unit 90 as a processing unit.

The image forming apparatus 1 is cuboid as a whole. As shown in FIGS. 1 to 5, the height direction of the image forming apparatus 1 is the up-down direction thereof, and the direction along the longer side of the image forming apparatus 1 in the plain view is the right-left direction thereof, and the direction along the shorter side of the image forming apparatus 1 in the plain view is the front-back direction thereof. In FIG. 1, the side toward the plane of the figure is the front side, and the backward side of the figure is the back side of the image forming apparatus 1.

The description on arrangements and directions of components of the image forming apparatus 1 is based on the precondition that the image forming apparatus 1 is in an ideal state without alignment errors or errors in parts of the apparatus, unless otherwise specified.

[Outer Cover]

The outer cover 20 is made of resin or sheet metal that covers the back, left, right, and top surfaces and the lower portion of the front surface of the main frame 100.

The upper portion of the front surface of the main frame 100, which is not covered by the outer cover 20, is covered by the outer door 21 and the compartment door 22.

The outer door 21 and the compartment door 22 form a double door. The doors 21, 22 transition from their closed states to open states as their respective swinging ends swing in directions so as to separate from each other.

The outer door 21 is rectangular as viewed from the front and includes a support shaft extending in the up-down direction at the left end of the outer door 21. The outer door 21 opens when its right end swings in the left direction.

The compartment door 22 is rectangular as viewed from the front and includes a support shaft extending in the up-down direction at the right end. The compartment door 22 opens when its left end swings in the right direction.

The compartment door 22 has a width that covers the front side of the toner compartment 110 that locates in the right in the main frame 100 and houses toner bottles B.

The outer door 21 has a width that covers the front side of the entire main frame 100 except for the toner compartment 110. The right-left width of the outer door 21 is wider than the right-left width of the compartment door 22.

The main frame 100 includes sensors (not illustrated) each of which detects whether the outer door 21/the compartment door 22 is open or closed.

[Main Frame]

The main frame 100 is a cuboid frame body that supports the entire structure of the image forming apparatus 1.

The main frame 100 includes the toner compartment 110 in the right end of the inner space and a printhead-unit compartment 120 on the left of the toner compartment 110. The toner compartment 110 houses toner bottles B that contain toner to be used for image formation. The printhead-unit compartment 120 houses printhead units PH (shown in FIG. 10).

The main frame 100 further includes, in its inner space, a drum-unit compartment 140 on the left of the printhead-unit compartment 120 and an intermediate-transfer-unit compartment 150 on the left of the drum-unit compartment 140. The drum-unit compartment 140 houses drum units 80. The intermediate-transfer-unit compartment 150 houses an intermediate transfer unit 90 that is long in the up-down direction.

The image forming apparatus 1 forms color images by forming images with respective colors of yellow, magenta, cyan, and black. The image forming apparatus 1 has four toner bottles B, four printhead units, and four drum units 80.

The toner bottles B are cylindrical containers. Each of the toner bottles B is housed in the tonner compartment 110 such that the central axis of the tonner bottle B is in the front-back direction.

The toner compartment 110 has four round housing holes arranged in the up-down direction. The tonner bottles B can be pulled out from or pushed into their respective housing holes.

The printhead-unit compartment 120 is enclosed by partitions 125, 126 in all directions, namely in the front-back and right-left directions (only the front partition 125 and the left partition 126 are illustrated). The printhead-unit compartment 120 houses four printhead units (not illustrated) arranged in the up-down direction.

Each of the printhead units is an exposure device and includes laser elements as light sources of exposure and an optical system.

The printhead-unit compartment 120 has four printhead reference shafts 121 to 124 for appropriately positioning the respective printhead units. The printhead reference shafts 121 to 124 are arranged in the up-down direction and are parallel to the front-back direction.

The front ends of the printhead reference shafts 121 to 124 protrude forward from the front partition 125 of the printhead-unit compartment 120. The back ends of the printhead reference shafts 121 to 124 protrude backward from the back partition.

The four printhead reference shafts 121 to 124 are mounted inside the printhead-unit compartment 120 and are supported by support frames (not illustrated). The support frames are processed and assembled with high accuracy so as to accurately position the printhead units.

Although processing accuracy generally tends to decrease conspicuously in processing a larger component, the inventor of the present invention has found out that positional accuracy of formed holes can be kept at a relatively high level.

On the basis of the finding, support holes are formed at highly accurate positions on the support frames (not illustrated), and parts of the support frames are assembled with screw holes formed at highly accurate positions. The four printhead reference shafts 121 to 124 are inserted in their corresponding support holes.

Accordingly, the axial centers of the printhead reference shafts 121 to 124 align in a straight line as viewed from the front-back direction, and the printhead reference shafts 121 to 124 are highly parallel to each other, and the printhead reference shafts 121 to 124 are horizontal and accurately keep aimed distances between each other in the up-down direction.

The uppermost and downmost printhead reference shafts 121, 124 that are most separate from each other among the four printhead reference shafts 121 to 124 are longer than the other two printerhead reference shafts 122, 123. The printhead reference shafts 121, 124 also have longer portions protruding forward and backward from the partitions 125 than the printerhead reference shafts 122, 123.

The front ends of the printhead reference shafts 121, 124 protruding forward from the front partition 125 and the back ends thereof protruding backward from the back partition serve as positioning shafts for positioning the other processing units. More specifically, the front ends of the printhead reference shafts 121, 124 determine the position of the door-type positioning panel 60, and the back ends of the printhead reference shafts 121, 124 determine the position of a fixed positioning panel 70 to be described later. By determining the positions of these positioning panels 60, 70, the front and back ends of the printhead reference shafts 121, 124 determine the positions of drum drive shafts 831 of the drum units 80 and the position of an intermediate transfer shaft 931 of the intermediate transfer unit 90.

The drum-unit compartment 140 houses four drum units 80 arranged in the up-down direction.

Each of the drum units 80 includes a photoconductive drum 81 and other peripherals, such as a charger, a developer, a transfer device, a toner collection equipment, and a static eliminator that are integrally supported by a unit frame 82 that is cuboid and long in the front-back direction.

The photoconductive drum 81 is rotatable on the drum drive shaft 831 that is not supported by the unit frame 82 and parallel to the front-back direction.

In the drum-unit compartment 140, the unit frame 82 for each of the drum units 80 is supported by a rail (not illustrated) along the front-back direction so as to be slidable in the front-back direction.

Thus, the drum units 80 can be pulled forward and pushed backward. Each of the drum units 80 can also be taken out of the drum-unit compartment 140 and the image forming apparatus 1.

Figure 6:
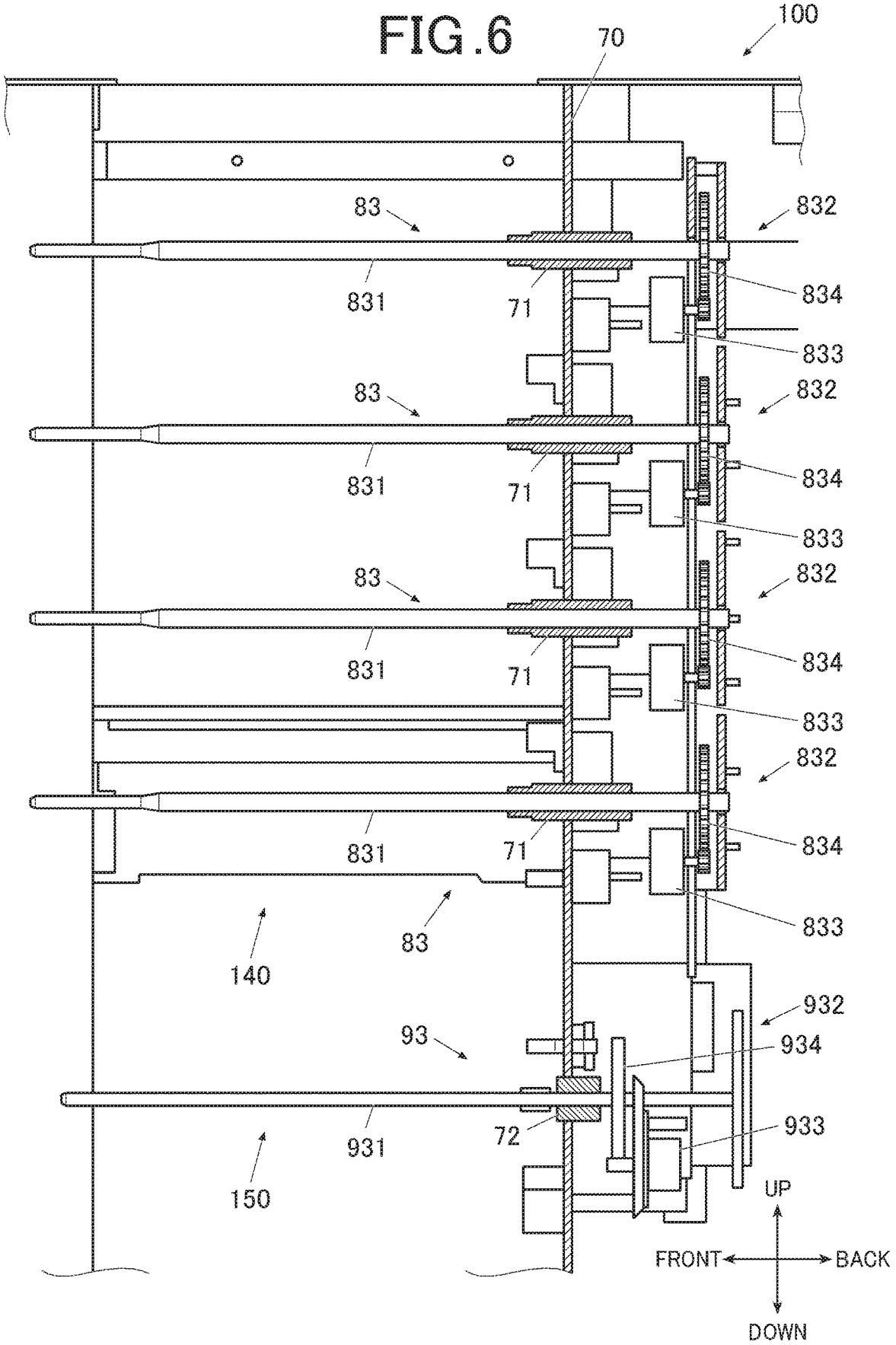
FIG. 6 is a cross-sectional view of the image forming apparatus as viewed from the right with all the drum units taken outside.
Figure 7:
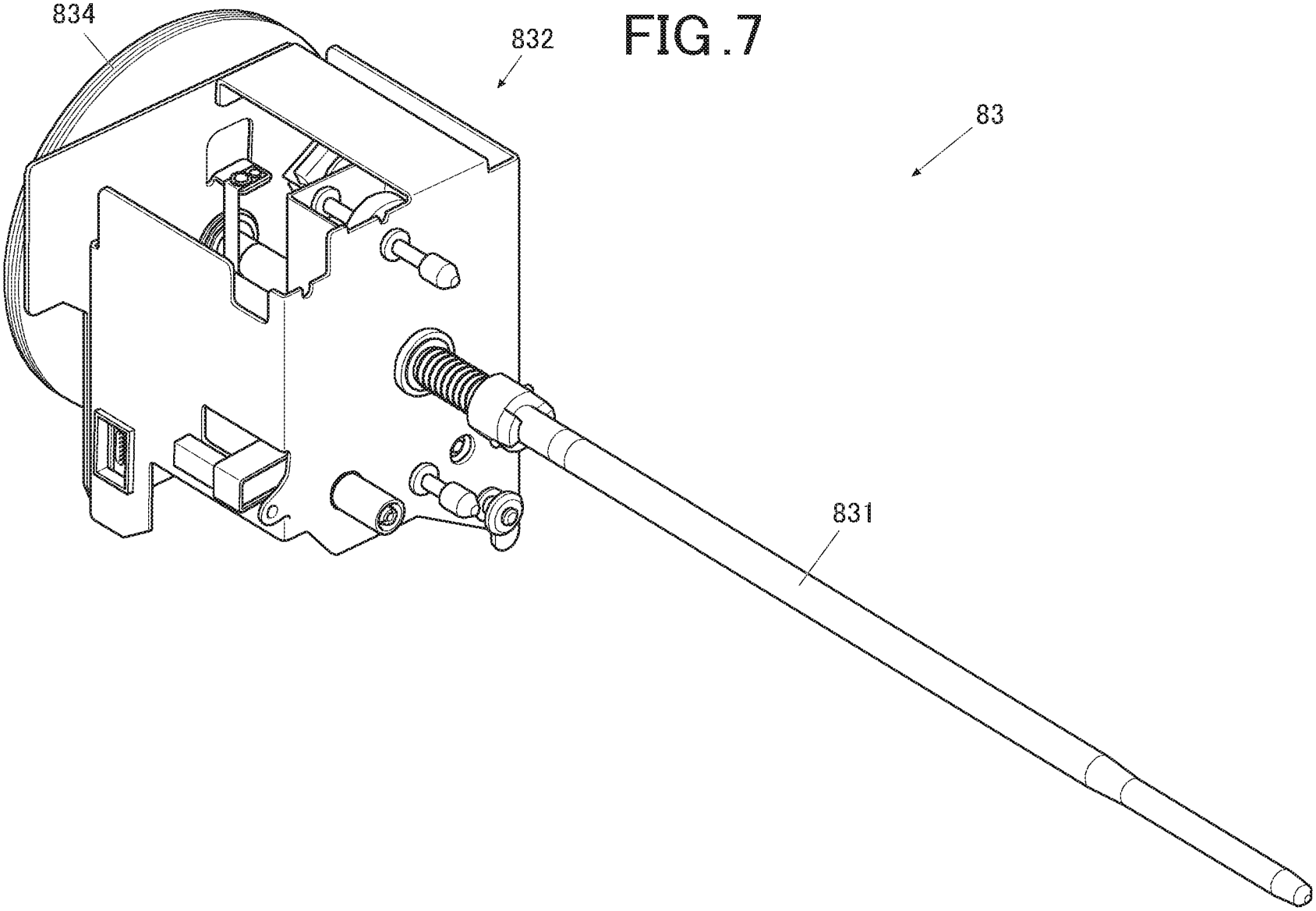
FIG. 7 is a perspective view of a drive mechanism of one of the drum units.
Figure 8:
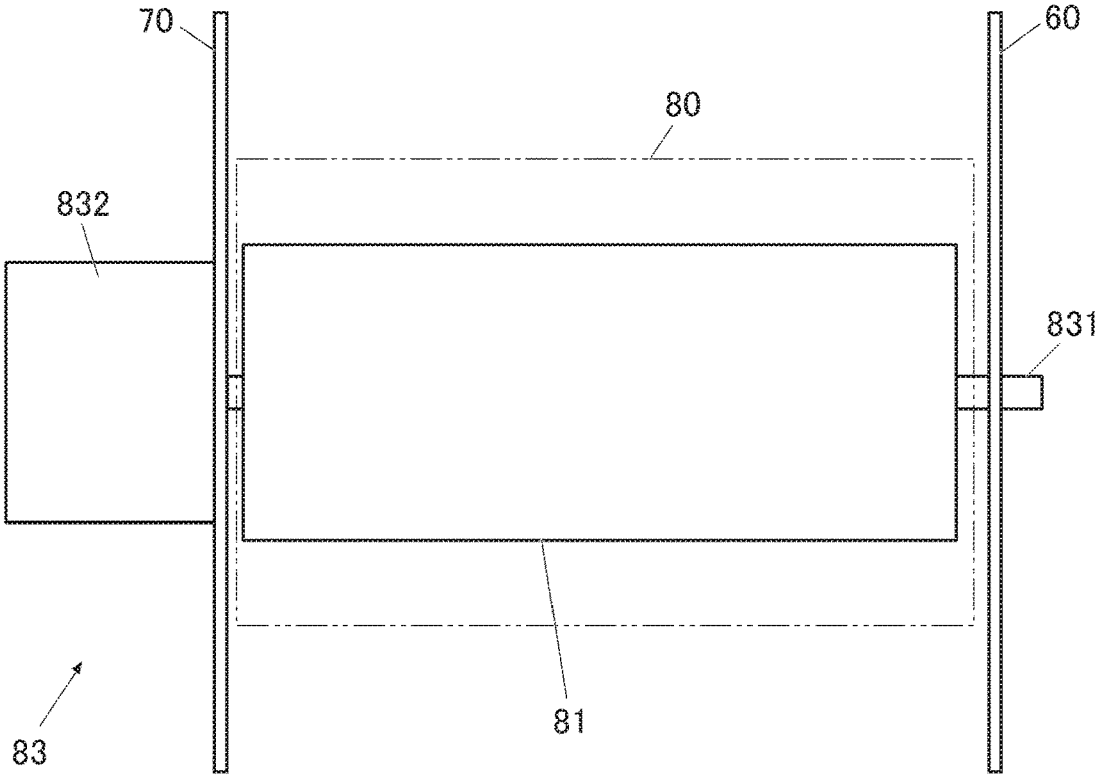
FIG. 8 is a schematic view of a drum drive shaft when the drum unit is housed.
Figure 9:
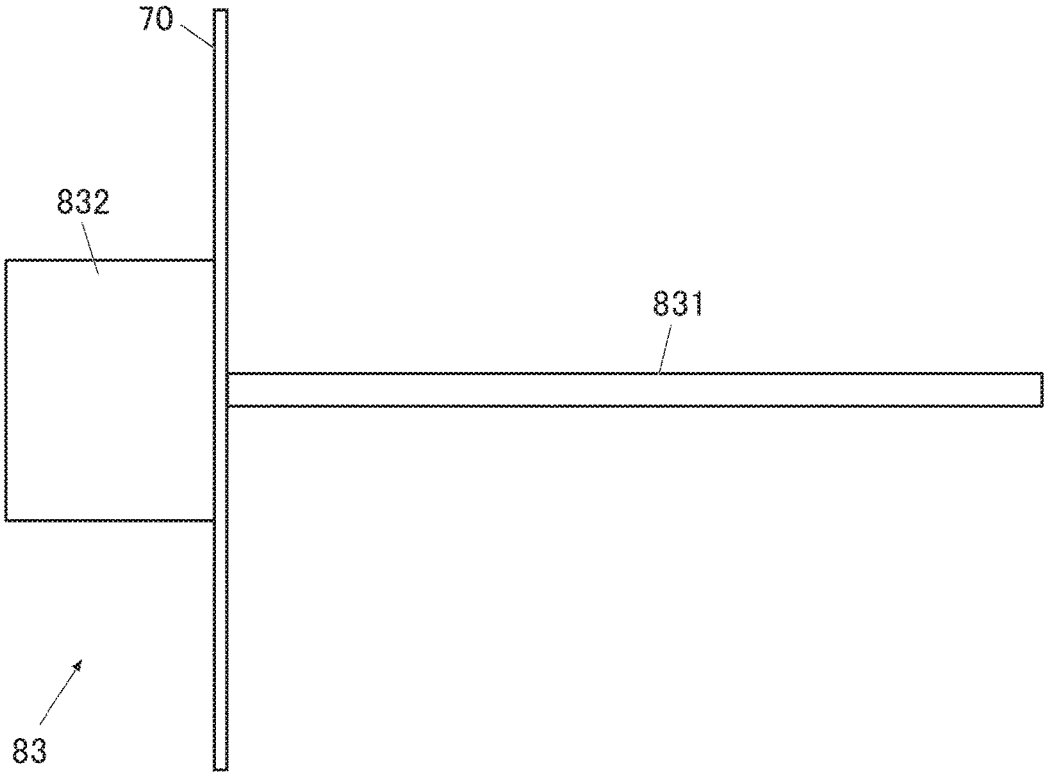
FIG. 9 is a schematic view of the drum drive shaft when the drum unit is pulled out.

FIG. 6 is a cross-sectional view of the image forming apparatus 1 as viewed from the right when all the drum units 80 are taken out of the drum-unit compartment 140. FIG. 7 is a perspective view of a drive mechanism 83 of one of the drum units 80. FIG. 8 is a schematic view of a drum drive shaft 831 when the drum unit 80 is housed. FIG. 9 is a schematic view of the drum drive shaft 831 when the drum unit 80 is taken out.

The four drive mechanisms 83 for the respective drum units 80 are arranged in the up-down direction as with the drum units 80, and are supported by the fixed positioning panel 70.

Each of the drive mechanisms 83 includes the drum drive shaft 831 and a driver 832. The drum drive shaft 831 is a processing drive shaft that rotates in a state of being inserted in the center of the photoconductive drum 81 in the housed drum unit 80. The driver 832 includes a motor 833 as the drive source of rotating the drum drive shaft 831 and a decelerator 834.

For each of the drivers 832 of the drum units 80, the motor 833 and the decelerator 834 are supported by the main frame 100 behind the fixed positioning panel 70. The fixed positioning panel 70 is fixed in the back in the main frame 100.

The back end (first end) of the drum drive shaft 831 for each of the drum units 80 is rotatably supported by a sleeve bearing 71 that is mounted through the fixed positioning panel 70, and is set at a predetermined position on a plain along the up-down and right-left directions. The head of the back end of the drum drive shaft 831 is connected to the decelerator 834.

The front end (second end) of the drum drive shaft 831 for each of the drum units 80 extends through the drum-unit compartment 140 and protrudes forward. The head of the front end is chamfered (chamfering is not illustrated in FIGS. 8, 9). The head of the front end of the drum drive shaft 831 may be rounded around the axis, instead of being chamfered.

When the drum unit 80 is housed and the door-type positioning panel 60, which can be opened and closed, is closed, the drum drive shaft 831 is inserted in through the center of the photoconductive drum 81. The back end of the drum drive shaft 831 is supported by the fixed positioning panel 70, and the front end thereof is supported by the door-type positioning panel 60, as shown in FIG. 8.

When the drum unit 80 is pulled out of the apparatus 1, the back end of the drum drive shaft 831 is supported by the fixed positioning panel 70, whereas the front end thereof is not supported. Thus, only one end of the drum drive shaft 831 is supported.

The intermediate-transfer-unit compartment 150 houses the intermediate transfer unit 90 that is long in the up-down direction.

The intermediate transfer unit 90 includes: an intermediate transfer body having an endless circular body and being oval as viewed from the front; a driven roller(s) that supports and conveys the intermediate transfer body; an intermediate transfer roller that receives rotative power from outside; and a unit frame 92 that supports the intermediate transfer roller and the driven roller.

When the intermediate transfer body passes through the four drum units 80, toner images of the respective colors formed on the photoconductive drums 81 are transferred onto the intermediate transfer body so as to be superposed on one another. The intermediate transfer body then transfers the formed toner image onto a recording medium.

In the intermediate-transfer-unit compartment 150, the unit frame 92 of the intermediate transfer unit 90 is supported by a guide along the front-back direction (not illustrated) so as to be slidable in the front-back direction.

Thus, the intermediate transfer unit 90 can be pushed backward and pulled forward, as with the drum units 80. The intermediate transfer unit 90 can also be taken out of the intermediate-transfer-unit compartment 150 and the image forming apparatus 1.

The drive mechanism 93 of the intermediate transfer unit 90 is supported by the fixed positioning panel 60 in the lower left of the drive mechanisms 83 of the drum units 80, as shown in FIG. 6.

The drive mechanism 93 includes an intermediate transfer shaft 931 and a driver 932. The intermediate transfer shaft 931 is a processing drive shaft that rotates in a state of being inserted in the center of intermediate transfer roller of the intermediate transfer unit 90. The driver 932 includes a motor 933 and a decelerator 934. The motor 933 is the drive source of rotating the intermediate transfer shaft 931.

The motor 933 and the decelerator 934 for the driver 932 of the intermediate transfer unit 90 are supported behind the fixed positioning panel 70 by the main frame 100.

The back end (first end) of the intermediate transfer shaft 931 of the intermediate transfer unit 90 is rotatably supported by a sleeve bearing 72 that penetrates through the fixed positioning panel 70, and is set at a predetermined position on a plain along the up-down direction and the right-left direction. The head of the back end of the intermediate transfer shaft 931 is connected to the decelerator 934.

The front end (second end) of the intermediate transfer shaft 931 for the intermediate transfer unit 90 extends through the intermediate-transfer-unit compartment 150 and protrudes forward. The head of the front end is chamfered. The head of the front end of the intermediate transfer shaft 931 may be rounded around the shaft, instead of being chamfered.

When the intermediate transfer unit 90 is housed and the door-type positioning panel 60, which can be opened and closed, is closed, the intermediate transfer shaft 931 passes through the center of the intermediate transfer roller. The back end of the intermediate transfer shaft 931 is supported by the fixed positioning panel 70, and the front end thereof is supported by the door-type positioning panel 60.

When the intermediate transfer unit 90 is pulled out of the image forming apparatus 1, the back end of the intermediate transfer shaft 931 is supported by the fixed positioning panel 70, whereas the front end thereof is not supported. Thus, only one end of the intermediate transfer shaft 931 is supported.

[Fixed Positioning Panel]

Figure 10:
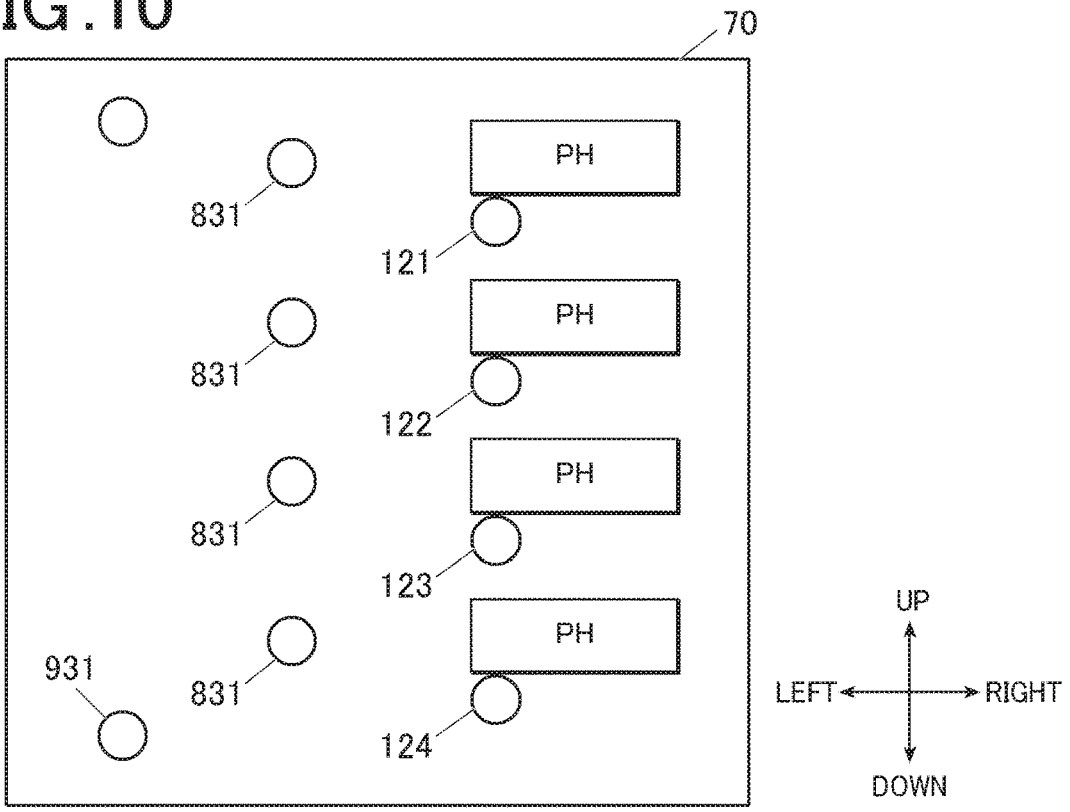
FIG. 10 is a schematic view of a fixed positioning panel that shows positions of shafts as viewed from the front.

FIG. 10 is a schematic view of the fixed positioning panel 70 that shows positions of the respective shafts as viewed from the front.

The fixed positioning panel 70 is a flat plate fixed at the back portion in the main frame 100 in a state of being parallel to the up-down and right-left directions.

The fixed positioning panel 70 has (i) fit holes into which the back ends of the printhead reference shafts 121, 124 are inserted to determine the position of the fixed positioning panel 70, (ii) insert holes that support and position, with the bearings 71 (not illustrated in FIG. 10), the back ends of the four drum drive shafts 831, and (iii) an insert hole that supports and positions, with the bearing 72 (not illustrated in FIG. 10), the back end of the intermediate transfer shaft 931.

The printhead reference shafts 121, 124 are fixed to the main frame 100 with high positional accuracy. The position of the fixed positioning panel 70 is determined highly accurately by inserting the printhead reference shafts 121, 124. The fixed positioning panel 70 is then fixed to the main frame 100.

As described above, the fit holes and the insert holes for the respective shafts can be formed on the fixed positioning panel 70 with high positional accuracy. Thus, the relative positional relationship among the fit holes for the printhead reference shafts 121, 124 and the insert holes for the drum drive shafts 831 and the intermediate transfer shaft 931 is kept highly accurately.

The fixed positioning panel 70 therefore maintains high positional accuracy of the back ends of the four drum drive shafts 831 and the back end of the intermediate transfer shaft 931.

[Door-Type Positioning Panel]

Figure 11:
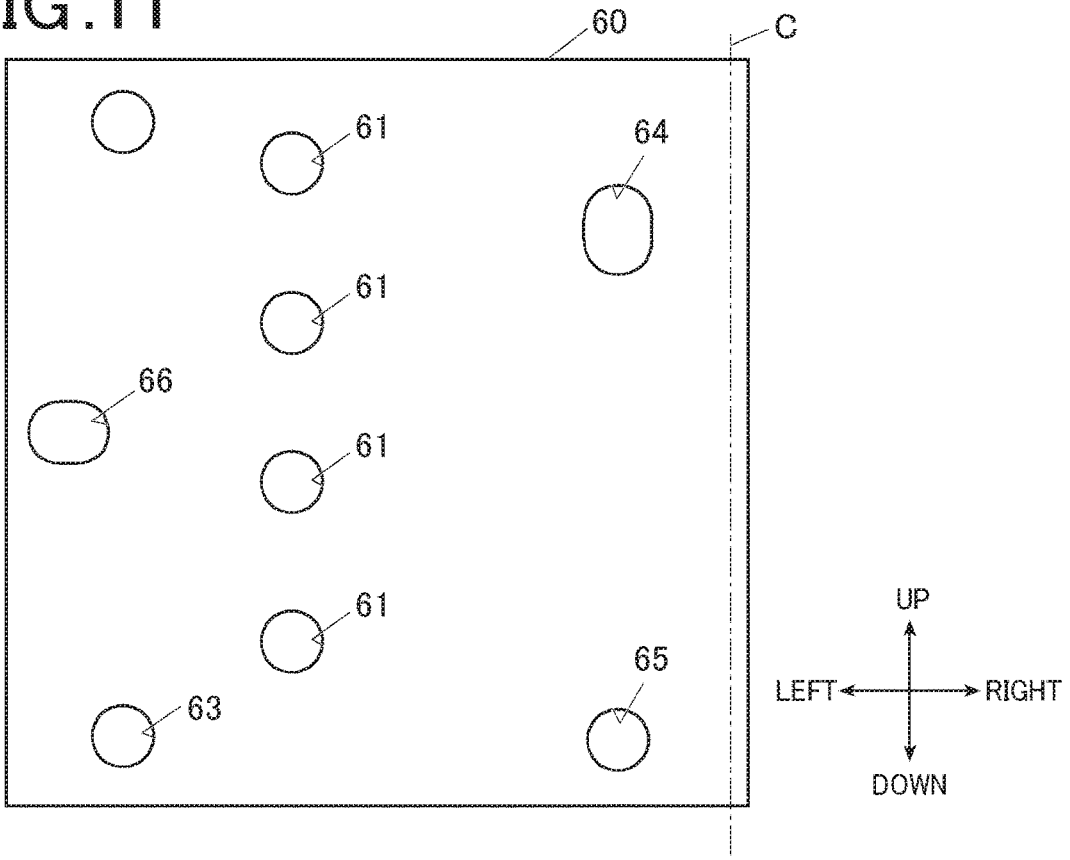
FIG. 11 is a schematic view of the door-type positioning panel as viewed from the front.
Figure 12:
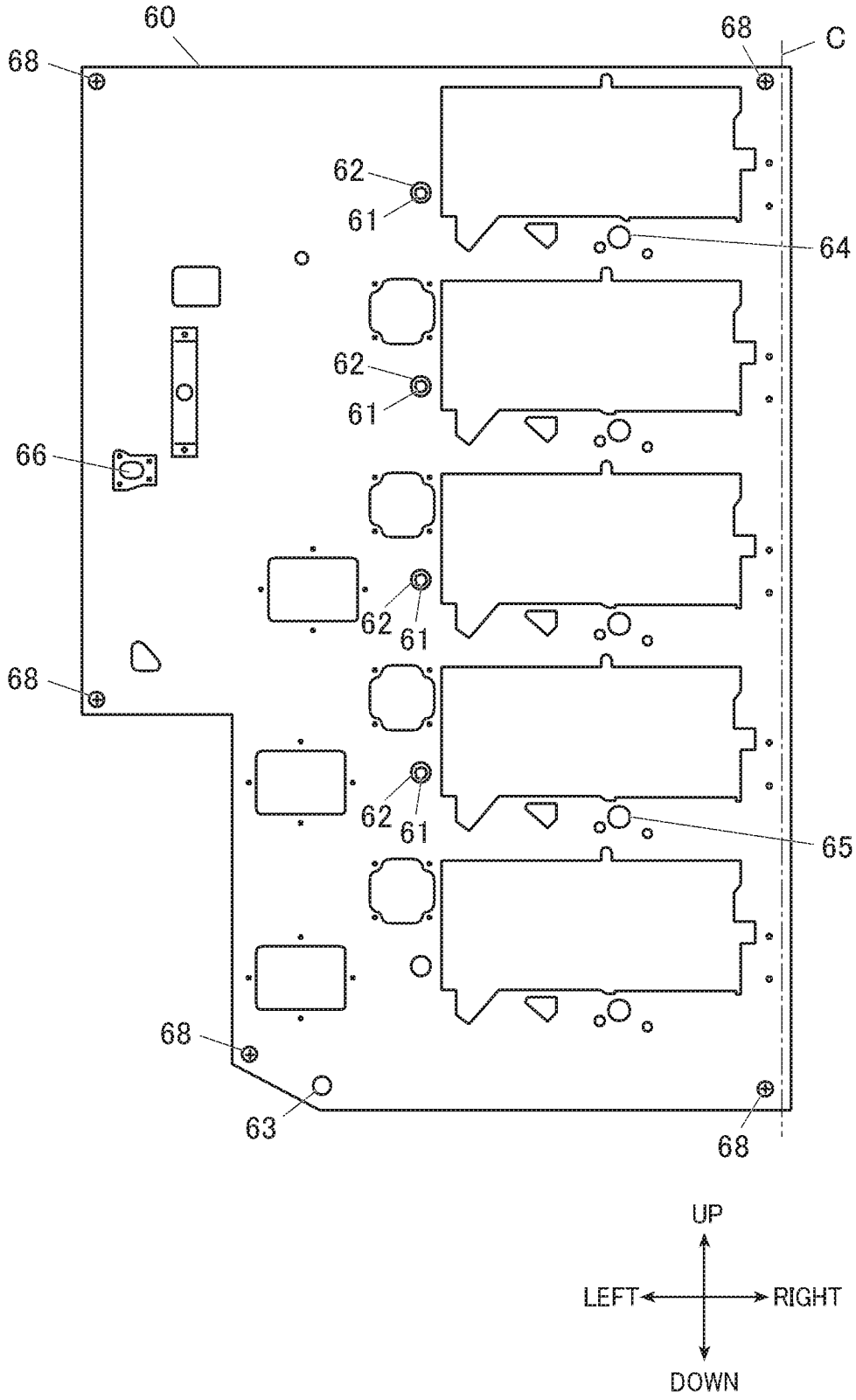
FIG. 12 is a front view of the door-type positioning panel.
Figure 13:
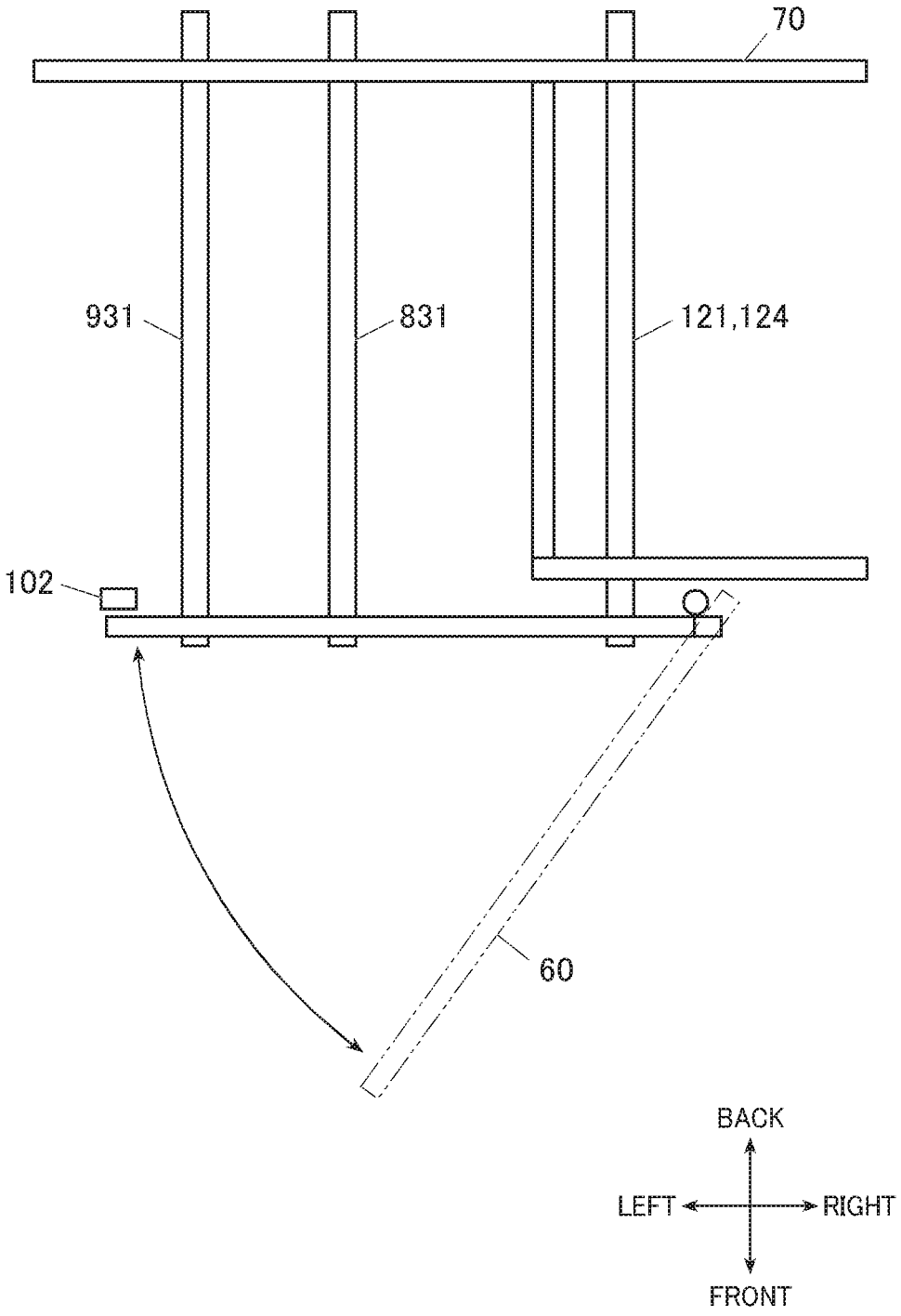
FIG. 13 is a plan view of the door-type positioning panel.

FIG. 11 is a schematic view of the door-type positioning panel 60 as viewed from the front. FIG. 12 is a front view of the door-type positioning panel 60. FIG. 13 is a plan view of the door-type positioning panel 60.

The door-type positioning panel 60 is located at the front side of the main frame 100, and can be opened and closed. In a state of being closed, the door-type positioning panel 60 is parallel to the up-down direction and the right-left direction. The door-type positioning panel 60 can swing on the support shaft C that is at the right end of the panel 60 and parallel to the up-down direction. The door-type positioning panel 60 is in a closed state when being parallel to the up-down direction and the right-left direction. The door-type positioning panel 60 is in an opened state when the left end of the panel 60 swings forward on the support shaft C.

The right end of the door-type positioning panel 60 is connected to the main frame 100 with a hinge(s) as a supporter (not illustrated) and can swing on the support shaft C. The hinge has play in the axial or radial direction or in both directions of the axis of the hinge along the support shaft C. This allows the door-type positioning panel 60 to swing smoothly under its own weight. The hinge therefore may not contribute to the positional accuracy of the door-type positioning panel 60.

To deal with this, fit holes 64, 65 are formed on the door-type positioning panel 60. The front ends of the printhead reference shafts 121, 124 are inserted in the respective fit holes 64, 65.

The lower fit hole 65 is a round hole having the inner diameter being approximately equal to the outer diameter of the printhead reference shaft 124. The printhead reference shaft 124 can be inserted in the fit hole 65 with hardly any space therebetween.

The upper fit hole 64 is a round hole having the right-left width being approximately equal to the outer diameter of the printhead reference shaft 121 and having the up-down width being slightly larger than the outer diameter of the printhead reference shaft 121. The printhead reference shaft 121 can be inserted in the fit hole 64 with hardly any space therebetween in the right-left direction.

Although errors in positional accuracy in processing the fit holes 64, 65 are reduced, it is almost impossible to reduce the errors to zero. The up-down width of the upper fit hole 64 is made to be slightly larger than the outer diameter of the printhead reference shaft 121. This allows a margin of errors.

The center of the fit hole 64 in the right-left direction and the center of the fit hole 65 are aligned in a straight line that is parallel to the support shaft C. Thus, the support shaft C is adjusted to be parallel to the up-down direction.

In addition to the two fit holes 64, 65 corresponding to the printhead reference shafts 121, 124, the door-type positioning panel 60 has a third fit hole 66 that fits a third positioning shaft 101 (shown in FIGS. 3 to 5). The fit hole 66 is formed at a position farther from the support shaft C than the intermediate-transfer-unit compartment 150. The fit hole 66 is a round hole having the up-down width being approximately equal to the outer diameter of the positioning shaft 101 and the right-left width being slightly larger than the outer diameter of the positioning shaft 101. The positioning shaft 101 can be inserted in the fit hole 66 with hardly any space therebetween in the up-down direction.

The right-left width of the fit hole 66 is slightly larger than the outer diameter of the positioning shaft 101. This allows a margin of positional errors in processing.

Thus, the position of the door-type positioning panel 60 is determined by three points of the printhead reference shafts 121, 124, and the positioning shaft 101 that do not align in the same straight line. The door-type positioning panel 60 can be kept at an accurate predetermined position even though there is some play around the support shaft C.

The door-type positioning panel 60 also has (i) four insert holes 61 in which the four drum drive shafts 831 of the drum units 80 are inserted to determine the positions of the drum drive shafts 831 and (ii) an insert hole 63*a* in which the intermediate transfer shaft 931 is inserted to determine the positon of the intermediate transfer shaft 931.

The position of the door-type positioning panel 60 in the closed state is accurately determined with respect to the main frame 100. Further, the fit holes 64, 65, 66 and the insert holes 61, 63 are formed at predetermined relative positions with high positional accuracy. Accordingly, the front ends of the drum drive shafts 831 and the intermediate transfer shaft 931 can be positioned highly accurately.

The centers of the four insert holes 61 in which the four drum drive shafts 831 are inserted and that determine the positions of the respective drum drive shafts 831 align in the same straight line. The line is parallel to the direction in which the centers of the fit holes 64, 65 align. Thus, the axial centers of the four drum drive shafts 831 can be positioned so as to align parallel to the support shaft C.

The four insert holes 61 in which the four drum drive shafts 831 are inserted are not directly formed on the door-type positioning panel 60. The insert holes 61 are formed with positioners 62 that are detachable to the door-type positioning panel 60.

Figure 14:
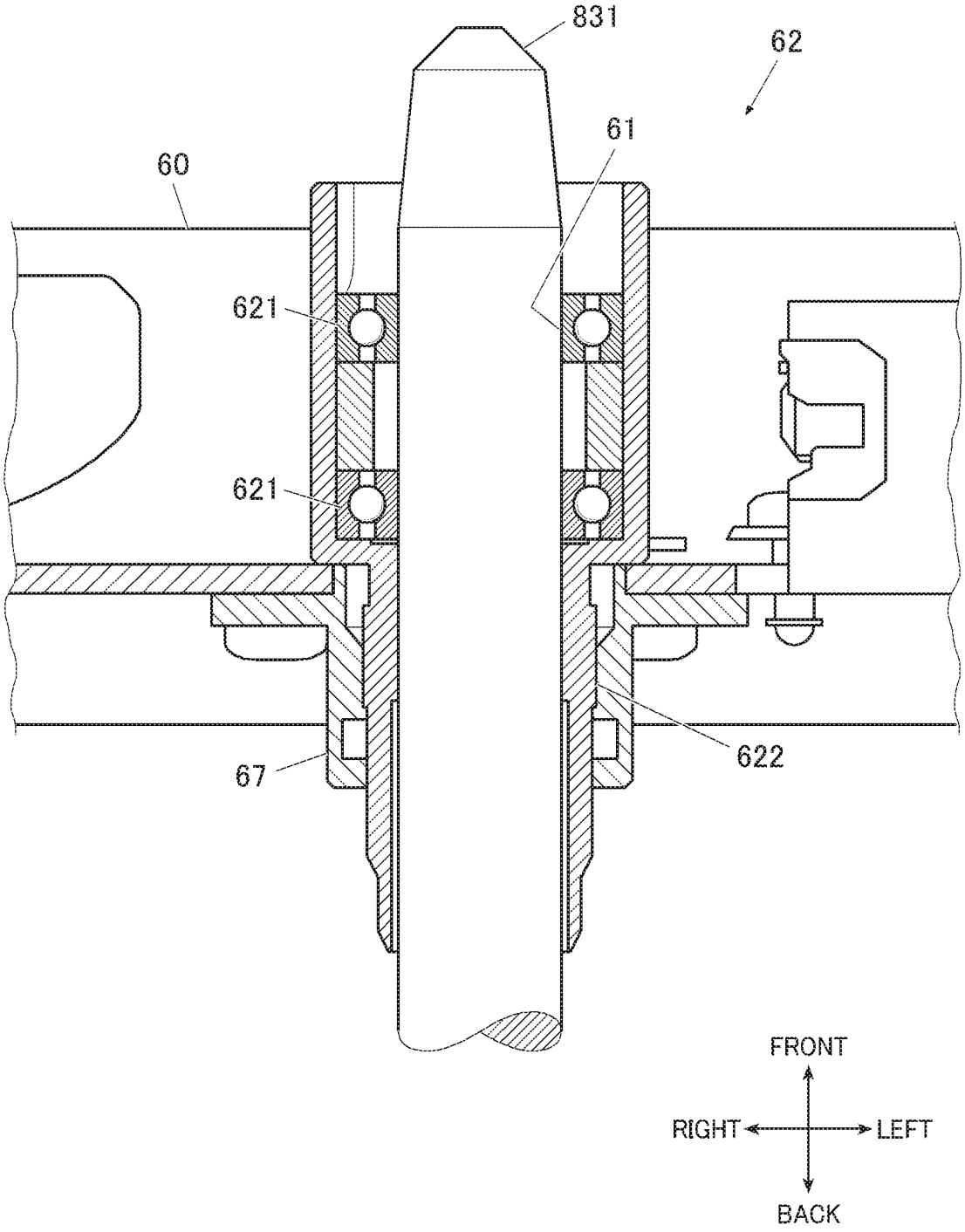
FIG. 14 is a cross-sectional view of a positioner along the drum drive shaft.

FIG. 14 is a cross-sectional view of one of the positioners 62 along the drum drive shaft 831. As illustrated, a cylindrical setting member 67 is set such that the center thereof coincides with the center of the corresponding drum drive shaft 831 on the door-type positioning panel 60. The setting member 67 has the inner diameter being sufficiently larger than the outer diameter of the drum drive shaft 831. The inner circumferential surface of the setting member forms an internal screw.

The positioner 62 is cylindrical. The outer circumferential surface of the positioner 62 forms an external screw 622 that screws on the internal screw of the setting member 67. On the inner circumferential surface of the positioner 62, two bearings 621 are provided.

The center of the inner ring of each of the bearings 621 coincides with the center of the cylindrical part of the positioner 62, and also coincides with the center of the setting member 67 when the positioner 62 is screwed on the setting member 67. The inner diameter of the inner ring of the bearing 621 is approximately equal to the outer diameter of the drum drive shaft 831. The drum drive shaft 831 hence can be inserted in the inner ring of the bearing 621. In other words, the inner side of the inner ring of each of the bearings 621 forms the insert hole 61 in which the corresponding drum drive shaft 831 is inserted.

The positioners 62 being detachable from the door-type positioning panel 60 and the insert holes 61 being inside the respective positioners 62 make it easier to position the drum drive shafts 831.

When the door-type positioning panel 60 is in the opened state, only one end of each drum drive shaft 831 is supported. The front end of each drum drive shaft 831 may be lowered from the predetermined position under its own weight and may greatly deviate from its corresponding insert hole 61. If the insert holes 61 are directly formed on the door-type positioning panel 60, the drum drive shaft 831 may have to be manually supported in closing the door-type positioning panel 60. Closing the door-type positioning panel 60 is further difficult when multiple drum drive shafts 831 are in such states.

To deal with this, in closing the door-type positioning panel 60, the positioners 62 are detached from the door-type positioning panel 60, and the drum drive shafts 831 are inserted into the setting members 67. The drum drive shafts 831 can be easily inserted into the setting members 67 even when the front ends of the drum drive shafts 831 are lowered, because the inner diameter of each setting member 67 is sufficiently larger than the diameter of the insert hole 61. In a state where the drum drive shaft 831 is loosely inserted in the setting member 67, the positioner 62 is inserted into the setting member 67 from the front. The positioner 62 is then screwed and fixed. Thus, the drum drive shaft 831 is set at its accurate position. Thus, the door-type positioning panel 60 can be easily closed and positioned even when the image forming apparatus 1 includes multiple drum drive shafts 831.

The insert hole 63 into which the intermediate transfer shaft 931 is inserted to determine the position thereof is directly formed on the door-type positioning panel 60. Instead, the insert hole 63 may be formed with a positioning member that is detachable from the door-type positioning panel 60, as with the insert holes 61 for the drum drive shafts 831.

The main frame 100 further includes a sensor 102 that serves as an opening-closing detector that detects opening and closing of the door-type positioning panel 60. The sensor 102 may be a contact detector, such as a micro switch that detects the opened and closed states of the door-type positioning panel 60 on the basis of contacts with the door-type positioning panel 60. The sensor 102 may also be an optical sensor, such as a photo interrupter that detects whether the door-type positioning panel 60 is present or absent. The sensor 102 may also be a proximity sensor that utilizes magnetism.

Preferably, the sensor 102 is set as far as possible from the support shaft C, for example, at a position farther from the support shaft C than the insert holes 61, 63 in the direction of the swinging radius of the door-type positioning panel 60. The closer the sensor 102 is to the support shaft C, the smaller the amount of movement of the door-type positioning panel 60 is in the direction of the tangential line with respect to the swinging angle of the door-type positioning panel 60, and accordingly more misdetections may occur. The farther the detector 102 is from the support shaft C, the higher the detection accuracy is.

The sensor 102, which detects opening and closing of the door-type positioning panel 60, outputs the state of the door-type positioning panel 60 (whether the panel 60 is open or closed) to a controlling device that controls the image forming process of the image forming apparatus 1, for example. When the door-type positioning panel 60 is open, the drum drive shafts 831 and the intermediate transfer shaft 931 are unstable and may shift from their correct positions. Images cannot be formed in such conditions.

When the controlling device receives, from the sensor 102, detection signals indicating that the door-type positioning panel 60 is open, or when the controlling device does not receive from the sensor 102 detection signals indicating that the door-type positioning panel 60 is closed, the controlling device performs control to stop the image forming process.

The door-type positioning panel 60, when closed to the main frame 100, is accurately positioned by the printhead reference shafts 121, 124 and the positioning shaft 101. The door-type positioning panel 60 also accurately positions, with the insert holes 61, 63, the drum drive shafts 831 and the intermediate transfer shaft 931. To maintain the state in which the door-type positioning panel 60 and the respective shafts are accurately positioned, the door-type positioning panel 60 is fixed to the main frame 100 with fixing screws 68 as fixers at multiple positions, as shown in FIG. 12.

The door-type positioning panel 60 has through-holes at multiple positions into which the fixing screws 68 are inserted. The through-holes have play with respect to the fixing screws 68 to allow positional shifts of the door-type positioning panel 60 in positioning. The door-type positioning panel 60 can be fixed to the main frame 100 at a determined position by the fixing screws 68 screwed on screw holes formed on the main frame 100.

The size and the position of the door-type positioning panel 60 is determined such that the entire front surface of the door-type positioning panel 60 in the closed state is covered by the above-described outer door 21 (shown in FIGS. 1, 2). That is, the outer door 21 needs to be opened in order to open the door-type positioning panel 60.

The door-type positioning panel 60 is also positioned such that the front surface thereof and the compartment door 22

(shown in FIGS. 1, 2) do not overlap as viewed from the front. Thus, the door-type positioning panel 60 is not accessible when the compartment door 22 is open.

The compartment door 22 is for accessing the toner compartment 110 to change the Milner bottles B. The compartment door 22 may be opened during the image forming operation for changing the toner bottles B, which can be changed as needed during the image forming operation.

On the other hand, when the door-type positioning panel 60 is accessed during the image forming operation, the drum drive shafts 831 and the intermediate transfer shaft 931 may shift or may not be supported. This may cause deterioration in image quality, imperfect image formation, and malfunction of the units 80, 90. To avoid this, the door-type positioning panel 60 is positioned so as not to be accessed when the compartment door 22 is open.

Technological Advantages of Embodiments

As described above, the image forming apparatus 1 includes the door-type positioning panel 60 that has the insert holes 61, 63 and the fit holes 64 to 66. The drum drive shafts 831 and the intermediate transfer shaft 931 are inserted in and supported by the insert holes 61, 63. The printhead reference shafts 121, 124 and the positioning shaft 101 fit to the fit holes 64 to 66. Thus, the drum drive shafts 831 and the intermediate transfer shaft 931 are positioned accurately in the main frame 100.

When the hinges have play in the axial or radial direction around the support shaft C and do not contribute to the positioning of the door-type positioning panel 60, the door-type positioning panel 60 is accurately positioned by at least three fit holes 64 to 66. Accordingly, the door-type positioning panel 60 can accurately position the drum drive shafts 831 and the intermediate transfer shaft 931.

When the hinges have little play in the axial or radial direction around the support shaft C of the door-type positioning panel 60 and contribute to the positioning of the door-type positioning panel 60, the fit holes for positioning the door-type positioning panel 60 may be less than three. In such a case, the door-type positioning panel 60 can be accurately positioned by the axis along the support shaft C and one fit hole.

Further, the door-type positioning panel 60 is positioned by the printhead reference shafts 121, 124 as the positioning shafts. Thus, the door-type positioning panel 60 can be accurately positioned with respect to the main frame 100, and accordingly, accurately position the drum drive shafts 831 and the intermediate transfer shafts 931.

Further, the two printhead reference shafts 121, 124, which are used as the positioning shafts, are most separate from each other among the printhead reference shafts 121 to 124. This further improves positional accuracy of the door-type positioning panel 60, the drum drive shafts 831, and the intermediate transfer shaft 931.

Further, the axial centers of the two printhead reference shafts 121, 124 align in a straight line parallel to the support shaft C. Thus, the door-type positioning panel 60 can be positioned so as not to incline with respect to the support shaft C.

Further, the door-type positioning panel 60 is provided with the detachable positioners 62 having the insert holes 61. This can restrain the drum drive shafts 831 from interfering with swinging movements of the door-type positioning panel 60 in closing the panel 60. This can improve workability in positioning.

Further, the positioners 62 include the bearings 621 in which the drum drive shafts 831 are inserted. The bearings 621 can reduce friction of the drum drive shafts 831 and allow the shafts 831 to smoothly rotate.

Further, the main frame 100 is provided with the sensor 102 that detects opening and closing of the door-type positioning panel 60. The sensor 102 notifies an external device, such as the controlling device of the image forming apparatus 1, whether the door-type positioning panel 60 is open or closed. This can improve cooperation among the components of the image forming apparatus 1 in prohibiting the image forming operation, for example, and stabilize the operation of the image forming apparatus 1.

Further, the sensor 102 detects whether the door-type positioning panel 60 is opened or closed at a position farther from the support shaft C of the door-type positioning panel 60 than the insert holes 61, 63 for the drum drive shafts 831 and the intermediate transfer shaft 931. This can reduce misdetections of opening and closing and improve detection accuracy.

Further, the door-type positioning panel 60 is positioned inside the outer door 21. Thus, the door-type positioning panel 60 can avoid direct contact from outside and can stably keep the drum drive shafts 831 and the intermediate transfer shaft 931 at their determined positions.

Further, the door-type positioning panel 60 is provided so as not to overlap the compartment door 22. Also, the swinging angle of the panel 60 in the opened state is limited to 90 degrees. Thus, the door-type positioning panel 60 does not interfere with the toner compartment 110 in both the opened and closed states.

The replacement of the toner bottles B in the toner compartment 110 is therefore not interrupted. This can improve workability.

Further, the outer door 21 and the compartment door 22 provided on the image forming apparatus 1 form a double door. Thus, the doors 21, 22 do not interfere with each other and can be smoothly opened and closed.

Further, the door-type positioning panel 60 is provided so as not to overlap the compartment door 22 and to be invisible when the compartment door 22 is open. Thus, the door-type positioning panel 60 is not accessible when the compartment door 22, which may be opened during the image forming operation, is open. Thus, the door-type positioning panel 60 can stably keep the drum drive shafts 831 and the intermediate transfer shaft 931 at their respective positions during image formation.

Further, the image forming apparatus 1 includes the fixed positioning panel 70 that is fixed to the inside of the main frame 100. Thus, the front and back ends of the drum drive shafts 831 and the intermediate transfer shaft 931 can be accurately positioned. This can improve quality of formed images.

Further, the door-type positioning panel 60 is provided at the front side of the main frame 100. The support shaft C is at the right end of the door-type positioning panel 60. This allows the door-type positioning panel 60 to be smoothly opened and closed. This can improve operability.

The support shaft C may be at the left end of the door-type positioning panel 60. Further, the door-type positioning panel 60 may be provided at the lateral or back side of the main frame 100 if no structural problem is caused in the image forming apparatus 1.

Further, the door-type positioning panel 60 includes the fixing screws 68 that fix the door-type positioning panel 60 in the closed state to the main frame 100. Thus, the door-type positioning panel 60 can stably keep the respective components at their determined positions.

Further, the front ends of the drum drive shafts 831 and the intermediate transfer shaft 931 are chamfered. This allows the respective shafts 831, 931 to be smoothly inserted into the insert holes 61, 63 in closing the door-type positioning panel 60. This can improve workability.

Instead of chamfering the drum drive shafts 831 and the intermediate transfer shaft 931, the insert holes 61, 63 may be chamfered or rounded.

OTHERS

Although embodiments of the present invention have been described and illustrated in detail, the disclosed embodiments are made for purposes of illustration and example only and not limitation. The details shown in the embodiments can be appropriately modified without departing from the scope of the present invention. The scope of the present invention should be interpreted by terms of the appended claims.

What is claimed is:

1. An image forming apparatus, comprising:

a processing unit that performs at least part of image formation;

a main frame that supports the processing unit such that the processing unit is pulled out or housed;

a drive source that is provided on the main frame and connected to a first end of a processing drive shaft of the processing unit to provide rotative power to the processing drive shaft; and a door-type positioning panel that positions and supports a second end of the processing drive shaft by using an insert hole, wherein an end of the door-type positioning panel is supported by the main frame such that the door-type positioning panel swings on a support axis, and the door-type positioning panel includes a fit hole that is closer to a swinging end of the door-type positioning panel than to the support axis and fits to a positioning shaft provided on the main frame.

2. The image forming apparatus according to claim 1, further comprising a printhead unit, wherein the positioning shaft includes a printhead reference shaft that positions the printhead unit in the main frame.

3. The image forming apparatus according to claim 2, further comprising multiple printhead units each of which is the printhead unit, wherein the positioning shaft includes two printhead reference shafts that are most separate from each other among multiple printhead reference shafts of the multiple printhead units, each of the multiple printhead reference shafts being the printhead reference shaft.

4. The image forming apparatus according to claim 3, wherein axial centers of the two printhead reference shafts that are most separate from each other are aligned in a straight line parallel to the support axis.

5. The image forming apparatus according to claim 1, wherein the door-type positioning panel is supported on the support axis with a supporter by the main frame, the supporter having play in an axial or radial direction, the positioning shaft includes at least three positioning shafts, and the door-type positioning panel includes fit holes each of which is the fit hole and fits to each of the at least three positioning shafts.

6. The image forming apparatus according to claim 1, wherein the door-type positioning panel is provided with a positioner that has the insert hole for positioning the second end of the processing drive shaft, the positioner being detachable from the door-type positioning panel.

7. The image forming apparatus according to claim 6, wherein the positioner includes a bearing and supports the second end of the processing drive shaft such that the processing drive shaft is rotatable.

8. The image forming apparatus according to claim 1, further comprising an opening-closing detector that detects whether the door-type positioning panel is opened or closed.

9. The image forming apparatus according to claim 8, wherein the opening-closing detector detects whether the door-type positioning panel is opened or closed at a position farther from the support axis of the door-type positioning panel than the insert hole for the processing drive shaft.

10. The image forming apparatus according to claim 1, wherein the door-type positioning panel is positioned inside an outer door.

11. The image forming apparatus according to claim 10, wherein the main frame includes a toner compartment that houses a toner bottle, and the door-type positioning panel is positioned, in both states of being opened and closed, so as not to interfere with the toner compartment.

12. The image forming apparatus according to claim 11, further comprising a compartment door for opening and closing the toner compartment, wherein the outer door and the compartment door form a double door.

13. The image forming apparatus according to claim 12, wherein the door-type positioning panel is positioned inside the outer door so as to be invisible when the compartment door is opened.

14. The image forming apparatus according to claim 1, further comprising a fixed positioning panel that is fixed to the main frame and supports and positions the first end of the processing drive shaft.

15. The image forming apparatus according to claim 1, wherein the door-type positioning panel is provided at a front, back, or lateral side of the main frame, and the support axis is at a front, back, or lateral end of the door-type positioning panel.

16. The image forming apparatus according to claim 1, further comprising a fixer that fixes the door-type positioning panel in a closed state to the main frame.

17. The image forming apparatus according to claim 1, wherein the second end of the processing drive shaft or the insert hole is chamfered or rounded.

18. The image forming apparatus according to claim 1, wherein the processing unit includes a drum unit, and the processing drive shaft includes a drum drive shaft.

19. The image forming apparatus according to claim 1, wherein the processing unit includes an intermediate transfer unit, and the processing drive shaft includes an intermediate transfer shaft.

* * * * *